US005975952A

United States Patent [19]

McCartin

[11] Patent Number: 5,975,952

[45] Date of Patent: Nov. 2, 1999

[54] CONTINUOUS ELECTRICAL CONNECTOR AND METHOD FOR MAKING SAME

[75] Inventor: Doug E. McCartin, Henryville, Ind.

[73] Assignee: Samtec, Inc., New Albany, Ind.

[21] Appl. No.: 09/017,060

[22] Filed: Feb. 2, 1998

[51] Int. Cl.[6] ..... H01R 13/40

[52] U.S. Cl. ..... 439/590; 439/937

[58] Field of Search ..... 439/590, 885, 439/937, 894; 206/716, 717; 29/883, 884

[56] References Cited

U.S. PATENT DOCUMENTS

| | | | |
|---|---|---|---|
| 2,396,725 | 3/1946 | Thomas, Jr. | 173/324 |
| 2,774,053 | 12/1956 | Seger | 339/198 |
| 3,097,036 | 7/1963 | Cornell, Jr. | 339/176 |
| 4,230,387 | 10/1980 | Zahn | 339/59 |
| 4,369,572 | 1/1983 | Atkins | 29/879 |
| 4,655,517 | 4/1987 | Bryce | 399/17 LC |
| 4,767,353 | 8/1988 | Hughes et al. | 439/398 |
| 4,832,622 | 5/1989 | Zahn | 439/590 |
| 4,952,156 | 8/1990 | Schmedding | 439/66 |
| 5,616,053 | 4/1997 | Bogursky et al. | 439/590 |
| 5,725,392 | 3/1998 | Bianca et al. | 439/590 |
| 5,775,945 | 7/1998 | Bianca et al. | 439/590 |

*Primary Examiner*—Steven L. Stephan
*Assistant Examiner*—Hae Moon Hyeon
*Attorney, Agent, or Firm*—Woodard, Emhardt, Naughton Moriarty & McNett

[57] ABSTRACT

Continuous electrical connectors. A continuous electrical connector is formed by joining a first a number of first connector bodies to a second number of second connector bodies by inserting a pin through corresponding holes in each of the connector bodies. The first connector bodies form a number of first splices when placed end-to-end, and the second connector bodies form a number of second splices when placed end-to-end. The first and second splices are staggered a distance so the bodies form a continuous connector that obviates the need to inventory a multitude of various connector sizes.

17 Claims, 1 Drawing Sheet

CONTINUOUS ELECTRICAL CONNECTOR AND METHOD FOR MAKING SAME

TECHNICAL FIELD OF THE INVENTION

The present invention generally relates to electrical connectors and, more particularly, to a continuous electrical connector and method for making the same.

BACKGROUND OF THE INVENTION

Electrical connectors are commonly used in the electronics industry in order to facilitate the interconnection of various components, usually by a plurality of conductive wires. Such connectors are typically formed as a row of a specified number of positions, with each position containing one or more connection sites. For example, a twelve position dual in-line connector will have twelve positions of two pins or connection sites each, for a total of 24 pins or connection sites. Similarly, a twelve position single in-line connector will have twelve positions for a single pin or connection site, for a total of 12 pins or connection sites.

Electrical connectors may generally be divided into two classes: through-hole connectors and surface mounted connectors. Surface mount connectors include a conductive lead for each position protruding from the bottom surface of the connector. Each lead is formed in a curved configuration such that the lead rests on a conductive pad on the surface of the printed circuit board. The surface mount leads are soldered to these conductive pads.

Through-hole connectors, on the other hand, include a row of conductive pins which protrude from their bottom surfaces and extend through holes formed in the printed circuit board to which the through-hole connector is mounted. Each of these pins is soldered to a conductive trace on the opposite side of the printed circuit board from this connector body. For example, if a through-hole connector has 24 pins, twenty-four through-holes will be formed in the printed circuit board with the same dimensional spacing between the through-holes as between the connector pins. In addition, a through-hole connector may have a pin protruding from the top of the connector body to allow a second printed circuit board to be mounted as described above and therefore electrically connected to the first board. Finally, a through-hole connector may include two or more rows of positions adjacent to and aligned with the original row.

When a through-hole connector is mounted onto a printed circuit board, each of the connector pins extend through a respective through-hole in the printed circuit board. There can therefore be no misalignment between the mounted connector and the printed circuit board, because the through-holes positively locate the connector mounting position. This feature makes through-hole connectors particularly advantageous over surface mount conductors to some manufacturers.

One disadvantage with the electrical connectors described above is that the end user may have a need for a number of connectors with a different number of positions. This requires either the connector manufacturer or purchaser, or both, to maintain a substantial inventory of electrical connectors with various lengths and numbers of positions.

Another disadvantage to electrical connectors having varying length requirements is that the manufacture of these connectors often results in wasted scrap material. For example, if the standard connector body includes 50 positions, and the end-user requires a 20 position connector, then two connectors may be formed therefrom, with twenty percent (20%) of the original connector having to be scrapped.

One attempt to address the foregoing shortcoming is disclosed in U.S. Pat. No. 4,832,622 to Zann. This patent discusses a continuous connector header via an extrusion or injection molding process. After the continuous body is formed, it is then drilled (if necessary) for the insertion of pins, or otherwise modified for insertion of other devices. The end user may then "cut to position" in order to form a connector with the desired number of positions.

While the foregoing prior art addresses some of the problems in manufacturing electrical connectors, it is not entirely satisfactory. First, continuous extrusion and injection molding techniques are very expensive, particularly when manufacturing a through-hole connector. It is much more cost effective to manufacture discrete, uniform header segments of a finite length (so long as potential scrap and inventory costs are not considered.) Second, the continuous manufacturing techniques involve a more difficult manufacturing process, which presents additional problems concerning quality control. For instance, if a defect is found in a continuous reel, then manufacturing must be stopped, or the entire reel may be unusable.

There is therefore a need in the prior art for a continuous electrical connector design that eliminates the scrap and inventory problems created by the varying position and length requirements of end-users, but is inexpensive and simple to manufacture. Such a design should also be readily integratable into existing manufacturing techniques. A need also exists for a continuous electrical connector design that allows continuation of the quality known by existing connector body designs and manufacturing techniques. The present invention is directed toward meeting that need.

SUMMARY OF THE INVENTION

The present invention relates to techniques for making and assembling continuous electrical connectors. The continuous electrical connector includes a first number of first connector bodies with a first end and a second end. Adjacent first connector bodies form a first splice when the first connector bodies are abutted first end to second end. The continuous electrical connector additionally includes a second number of second connector bodies with a third end and a fourth end. Adjacent second connector bodies form a second splice when the second connector bodies are abutted third end to fourth end. Each of the first and second connector bodies has a plurality of substantially uniformly spaced through-holes. The first and second connector bodies are joined by offsetting the first splice a distance from the second splice and inserting a pin through corresponding through-holes of each connector body. This results in a pattern in which the abutting ends of the first number of connector bodies are offset from the abutting ends of the second number of connector bodies. The present invention therefore obviates the need for a continuous extrusion or injection molding process to form a continuous electrical connector.

In one form of this invention, a through-hole connector is disclosed comprising a first connector body with a first and second end, and a second connector body with a third and fourth end. Each connector body has a plurality of substantially uniformly spaced through-holes. The first connector body and the second connector body are joined by a pin disposed through a corresponding through-hole of each connector body in such a manner that the first and second ends of the first connector body are offset from the third and fourth ends of the second connector body. Any number of additional first connector bodies and second connector bodies are abutted to respective first and second connector bodies and joined such that the resulting abutments are staggered.

In another form of the invention, a method of forming a continuous electrical connector is disclosed, comprising the steps of (a) providing a first number of first connector bodies having a first end and a second and a plurality of substantially uniformly spaced first through-holes; (b) providing a second number of second connector bodies having a third end and a fourth end and a plurality of substantially uniformly spaced second through-holes; (c) abutting the first end to the second end of adjacent first connector bodies to form a first splice; (d) abutting the third end to the fourth end of adjacent second connector bodies to form a second splice; and (e) joining the first connector bodies to the second connector bodies by inserting a pin through each of the corresponding first and second through-holes such that each first splice is staggered a distance from each second splice.

In another form of the invention, a continuous electrical connector is disclosed comprising a first number of first connector bodies, each having a first end and a second end and at least two rows of a plurality of substantially uniformly spaced first through-holes. The first connector bodies are abutted first end to second end to form a first splice. Also included are a second number of second connector bodies, each having a third end and a fourth end and at least two rows of a plurality of substantially uniformly spaced second through-holes. The second connector bodies are abutted third end to fourth end to form a second splice. A pin is inserted through each of the corresponding first and second through-holes such that each of the first splices are staggered a distance from each of the second splices.

DETAILED DESCRIPTION OF THE PREFERRED EMBODIMENT

Figure 1:
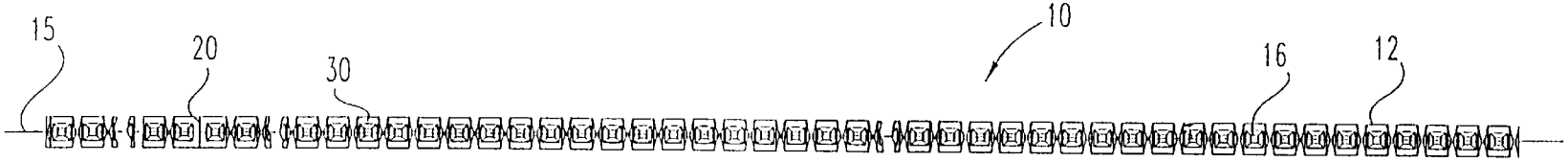
FIG. 1 is a top elevational view of a preferred embodiment continuous electrical connector of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
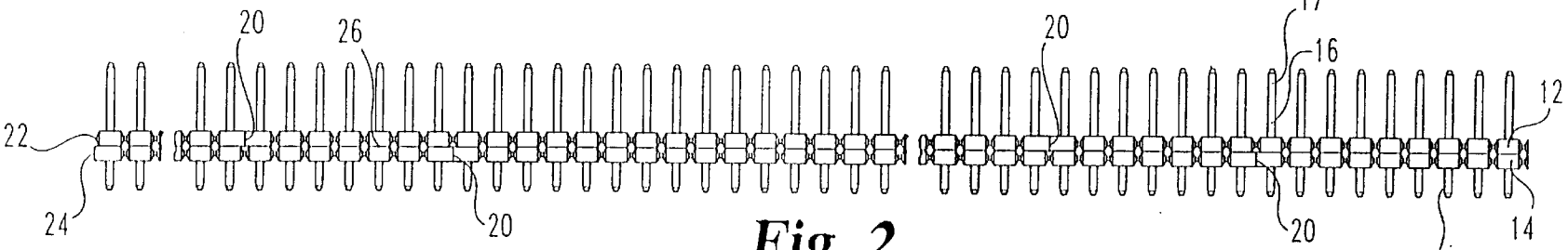
FIG. 2 is a side elevational view of the preferred embodiment continuous electrical connector of FIG. 1.

A first embodiment of the present invention is respectively illustrated in a top elevational view and a side elevational view of FIGS. 1 and 2, and indicated generally at 10. The continuous electrical connector 10 includes a top connector header 12 and bottom connector header 14 which hold a plurality of connector pins 16. The connector headers 12 and 14 include a number of connector bodies 12*a*, 12*b*, 12*c*, . . . , and 14*a*, 14*b*, 14*c*, . . . . Connector bodies 12*a* etc. and 14*a* etc. are preferably made from an insulator material, such as injection molded plastic, while the connector pins 16 may be made of any conductive metal, such as copper. Each of the conductor pins 16 are centered about a longitudinal axis 15 defined by the center of connector headers 12 and 14. Continuous connector 10 is typically mounted to a circuit board (not shown) by inserting pins 16 through a corresponding set of through-holes on the circuit board. The connector 10 is then typically soldered to corresponding circuit traces on the circuit board.

Figure 3:
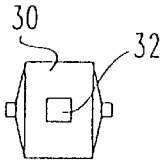
FIG. 3 is a detail view of one segment of the preferred embodiment connector body of the present invention.

Referring to FIG. 3, a detail view of a connector body segment 30 is illustrated. In the preferred embodiment, connector bodies 12*a*, 12*b*, 12*c*, . . . , and connector bodies 14*a*, 14*b*, 14*c*, . . . , define a plurality of uniform connector body segments 30 about their length. Each body segment 30 further defines a hole 32 therethrough. Hole 32 is designed to receive and grippingly engage pin 16. At the point where adjacent connector body segments are joined, the connector body's cross-sectional area is reduced. This design of the interconnection of connector body segments 30 allows continuous connector 10 to be flexible along its length, thus making it less susceptible to breakage when contorted.

Referring back to FIG. 2, it will be appreciated by those skilled in the art that pin 16 may include a lead portion 17 and a tail portion 13. Both lead portion 17 and tail portion 13 may be joined to circuit boards such that the boards are stacked. In one embodiment, tail portion 13 may be J-shaped for use in a surface mount connector applications. Other configurations of pins 16, lead portion 17, and tail portion 13 are also contemplated as known to those skilled in the art.

The present invention allows a plurality of connectors to be used as building blocks to form a continuous connector of any length. Referring to FIG. 2, it should be appreciated that top connector header 12 includes a number of connector bodies 12*a*, 12*b*, 12*c*, and so on. Similarly, bottom connector header 14 includes a number of connector bodies 14*a*, 14*b*, 14*c* and so on. It is to be understood that any number of connector bodies may be used to form the continuous connector 10.

When two connector bodies are placed end-to-end, or abutted, such as connector bodies 12*a* and 12*b*, for example, a splice 20 is formed. As shown in FIG. 2, both the top connector header 12 and bottom connector header 14 include a number of splices 20, each formed by the abutment between the ends of adjacent connector bodies. In order to join top connector header 12 and bottom connector header 14, it is necessary to offset the splices 20 along the top row of connector bodies 12*a*, etc. from the splices 20 along the bottom row of connector bodies 14*a*, etc. This allows pins 16 to be used to grippingly engage connector body 14*a*, for example, to both connector bodies 12*a* and 12*b*. This connection pattern is continued along the entire length of continuous connector 10.

The staggering of splices 20, represented by the "s" in FIG. 2, allows a number of pins to be used to engage the connector headers 12 and 14. It is to be understood that virtually any number of pins 16 may be included in the stagger s. In one embodiment, the stagger s is defined by the spacing between two pins 16. Alternatively, the stagger s may include a number of pins 16 that represents one half of the number of positions of a connector body, such as 12*a*, for example. Other embodiments contemplate a stagger s that includes any number of pins, even a non-constant number of pins (as would occur if connector bodies of different lengths were used), so long as top connector header 12 is adequately secured to bottom connector header 14.

Once the above assembly is complete, or during the assembly process, continuous connector 10 may be wound on a reel for shipment to the customer. Connector 10 may then be cut to the desired length with little or no waste, or scrap. Another advantage is realized by the use of discrete, finite connector bodies. These units may be manufactured prior to assembly, thus eliminating the need for expensive continuous extrusion or continuous injection molding type operations.

Figure 4:
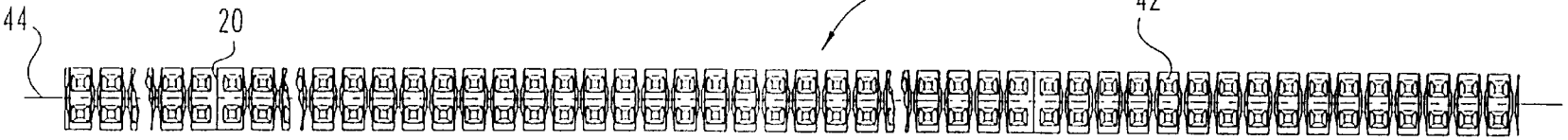
FIG. 4 is a plan view of an alternate embodiment of the continuous electrical connector of the present invention.

A second embodiment of the present invention is illustrated in a top plan view of FIG. 4, and indicated generally at 40. The second embodiment continuous connector is substantially similar to the first embodiment continuous connector 10 of FIGS. 1 and 2, with the exception that continuous connector 40 includes a body segment 42 that defines a plurality of through-holes to receive a plurality of pins 16. The dual rows of pins in the illustration are centered about longitudinal axis 44, however those having ordinary skill in the art will recognize that any number of pins may be incorporated into each body segment. Other features of the continuous connector 40 are the same as continuous connector 10 as described above, including the staggering of splices 20 to join top and bottom connector bodies.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A continuous electrical connector, comprising:

a first number of first connector bodies, each of the first connector bodies having a first end and a second end, such that adjacent first connector bodies are abutted first end to second end, thereby defining a first splice between each of the abutted first and second ends, the first connector bodies additionally defining a plurality of substantially uniformly spaced first through-holes;

a second number of second connector bodies, each of the second connector bodies having a third end and a fourth end, such that adjacent second connector bodies are abutted third end to fourth end, thereby defining a second splice between each of the abutted third and fourth ends, the second connector bodies additionally defining a plurality of substantially uniformly spaced second through-holes; and a plurality of pins inserted through respective ones of each of the first and second through-holes to join the first and second connector bodies, wherein each first splice is staggered a distance from each second splice.

2. The continuous electrical connector of claim 1, wherein respective first and second lengths of the first and second connector bodies are the same.

3. The continuous electrical connector of claim 1, wherein each of the first and second connector bodies defines a plurality of connector body segments, each of the segments including one of the through-holes.

4. The continuous electrical connector of claim 1, wherein each of the plurality of pins is substantially J-shaped.

5. The continuous electrical connector of claim 1, wherein each of the first and second connector bodies comprises injection molded plastic.

6. The continuous electrical connector of claim 1, wherein the stagger distance is defined by the spacing between at least two through-holes.

7. The continuous electrical connector of claim 1, wherein each of the first and second connector bodies includes a number of respective first and second through-holes, wherein the stagger distance is defined by a spacing required for one-half of the number of respective through-holes.

8. A method of forming a continuous electrical connector comprising the steps of:

(a) providing a first number of first connector bodies, each of the first connector bodies having a first end and a second end, the first connector bodies additionally defining a plurality of substantially uniformly spaced first through-holes;

(b) providing a second number of second connector bodies, each of the second connector bodies having a third end and a fourth end, the second connector bodies additionally defining a plurality of substantially uniformly spaced second through-holes;

(c) abutting the first end and the second end of adjacent first connector bodies to form a first splice between each of the abutted ends;

(d) abutting the third end and the fourth end of adjacent second connector bodies to form a second splice between each of the abutted ends; and (e) joining the first and second connector bodies by inserting a plurality of pins through respective ones of the first and second through-holes and staggering a distance each first splice from each second splice.

9. The method of claim 8, wherein step e) is performed prior to step (c).

10. The method of claim 8, wherein the stagger distance of step (e) is defined by the spacing between at least two through-holes.

11. The method of claim 8, wherein each of the first and second connector bodies of steps (a) and (b) include a number of respective first and second through-holes, wherein the stagger distance of step (e) is defined by a spacing required for one-half of the number of respective through-holes.

12. A continuous electrical connector, comprising:

a first number of connector bodies, each of the first connector bodies having a first end and a second end, such that adjacent first connector bodies are abutted first end to second end, thereby defining a first splice between each of the abutted first and second ends, the first connector bodies additionally defining at least two rows of a plurality of substantially uniformly spaced first through-holes;

a second number of connector bodies, each of the second connector bodies having a third end and a fourth end, such that adjacent second connector bodies are abutted third end to fourth end, thereby defining a second splice between each of the abutted third and fourth ends, the connector bodies additionally defining at least two rows of a plurality of substantially uniformly spaced second through-holes; and a plurality of pins inserted through respective ones of each of the first and second through-holes to join the first and second connector bodies, wherein each first splice is staggered a distance from each second splice.

13. The continuous electrical connector of claim 12, wherein each of the first and second connector bodies comprises injection molded plastic.

14. The continuous electrical connector of claim 12, wherein respective first and second lengths of the first and second connector bodies are the same.

15. The continuous electrical connector of claim 12, wherein each of the connector bodies defines a plurality of connector body segments, each of the segments including one of the through-holes.

16. The continuous electrical connector of claim 12, wherein the stagger distance is defined by the spacing between at least two through-holes.

17. The continuous electrical connector of claim 12, wherein each of the first and second connector bodies includes a number of respective first and second through-holes, wherein the stagger distance is defined by a spacing required for one-half of the number of through-holes.

* * * * *

UNITED STATES PATENT AND TRADEMARK OFFICE

CERTIFICATE OF CORRECTION

PATENT NO. : 5,975,952
DATED : November 2, 1999
INVENTOR(S) : McCartin

It is certified that error appears in the above-identified patent and that said Letters Patent is hereby corrected as shown below:

Column 6,
Line 26, please change "step e)" to -- step (e) --

Please replace the drawings with the formal drawings as follows:

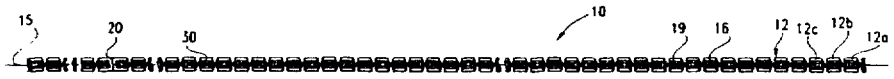

*Fig. 1*

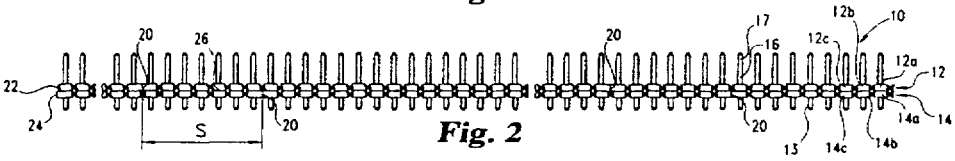

*Fig. 2*

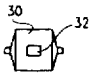

*Fig. 3*

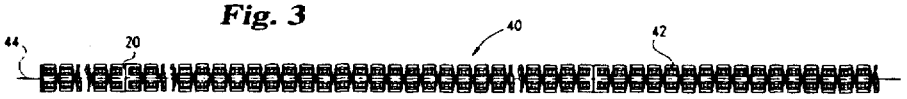

*Fig. 4*

Signed and Sealed this

Sixth Day of November, 2001

*Attest:*

Nicholas P. Godici

NICHOLAS P. GODICI
*Acting Director of the United States Patent and Trademark Office*

*Attesting Officer*